United States Patent [19]

Nunn, Sr. et al.

[11] Patent Number: 4,702,086

[45] **Date of Patent: * Oct. 27, 1987**

[54] REFRIGERATION SYSTEM WITH HOT GAS PRE-COOLER

[75] Inventors: John O. Nunn, Sr., Deer Park; John O. Nunn, Jr., Pasadena, both of Tex.

[73] Assignee: Turbo Coils Inc., Houston, Tex.

[ * ] Notice: The portion of the term of this patent subsequent to Mar. 25, 2003 has been disclaimed.

[21] Appl. No.: 872,808

[22] Filed: Jun. 11, 1986

[51] Int. Cl.[4] ..... F25B 41/00

[52] U.S. Cl. ..... 62/113; 62/117; 62/200; 62/513

[58] Field of Search ..... 62/498, 503, 505, 513, 62/113, 117, 197, 198, 199, 200

[56] References Cited

U.S. PATENT DOCUMENTS

| | | | |
|---|---|---|---|
| 2,022,774 | 12/1935 | Kucher | 62/513 X |
| 2,385,667 | 9/1945 | Webber | 62/513 X |
| 4,359,879 | 11/1982 | Wright | 62/513 |
| 4,577,468 | 3/1986 | Nunn, Jr. et al. | 62/513 |

*Primary Examiner*—Lloyd L. King

*Attorney, Agent, or Firm*—Neal J. Mosely

[57] ABSTRACT

A refrigeration system is disclosed having greatly improved efficiency. The system includes a pre-cooler heat exchanger for sub-cooling the refrigerant hot gas from the compressor before entering the condenser to render the entire evaporator more effective for refrigeration purposes. The heat exchanger for pre-cooling the hot gas has one passage through which the hot gas flows and another passage, in heat exchange relation therewith, which is connected to receive a small flow of liquid refrigerant bled off from the main stream of the liquid refrigerant which refrigerant passes through an expansion valve or capillary tube to vaporize so that the refrigerant hot gas is sub-cooled by the latent heat of vaporization of the vaporizing refrigerant. This heat exchanger is located between the compressor and the condenser. The flow of the vaporized refrigerant used for cooling in the heat exchanger is connected to the return flow of vaporized refrigerant flowing from the evaporator to the compressor. This heat exchanger may be used alone or in combination with a direct expansion liquid refrigerant pre-cooler as disclosed in U.S. Pat. No. 4,577,468.

22 Claims, 3 Drawing Figures

REFRIGERATION SYSTEM WITH HOT GAS PRE-COOLER

BACKGROUND OF THE INVENTION

1. Field of the Invention

This invention relates to new and improved refrigeration systems and more particularly to a system having a precooler heat exchanger for sub-cooling the refrigerant hot gas before entering the condenser.

2. Description of the Prior Art

It is well known in the art of refrigeration to improve efficiency by pre-cooling the liquid refrigerant flowing from the condenser to the receiver or flowing directly to the evaporator. Heat exchangers are employed in refrigeration systems for the exchange of heat between fluids, generally the cold refrigerant gases from the evaporator and warm liquid refrigerant from the condenser. The refrigerant gas which is exhausted from the evaporator of the refrigeration system is cold. The liquid refrigerant which s drawn from the condenser of a refrigeration system is warm. To improve the efficiency of the refrigeration system, it is desirable to heat exchange the warm liquid with the cold gas. The following patents illustrate the state of the art in pre-cooler technology:

Donovan U.S. Pat. No. 2,797,554 discloses a refrigeration apparatus including a heat exchanger which comprises, a shell construction with a central chamber and a pair of headers separated therefrom by a partition. Tube assemblies rigidly mounted on the partition and opening into the headers provide a passageway between the headers. Each tube assembly has its central portion contracting the other tube assemblies to form the walls of fluid passageways extending longitudinally along the outer surfaces thereof. Each tube assembly has ends of reduced cross-section providing a surrounding header zone in the shell at each end. Each tube assembly includes internal fins for heat exchange between fluids passing through the tube assemblies and through the central chamber shell externally of the tube assemblies. Gas is delivered to one of the headers and withdrawn from the other of the headers, and liquid is delivered to one of the header zones and withdrawn from the other header zone.

Boling, U.S. Pat. No. 2,956,419 discloses an arrangement for maintaining stable operation of refrigeration systems having air-cooled condenses throughout wide variations in the temperature of the cooling air. The invention also provides for maintaining stable operation of refrigeration systems having other types of condensers used with cooling towers.

Marlo U.S. Pat. No. 3,082,610 discloses that refrigerant flow controls are more efficient when the fluctuation of the pressures at their inlet and outlet ports are not unduly great; and that controlling the pressures at the inlet ports keeps those pressures from falling too low. In compressionexpansion refrigeration systems, the liquid pressures in the receivers of those systems should be kept from falling to unduly low levels. With water-cooled condensers, it is easy to keep the liquid pressures from falling too low; but not with air-cooled condensers. A method and apparatus are disclosed for maintaining the liquid pressure in the receiver of an air-cooled refrigeration system above a predetermined minimum level.

Bottom U.S. Pat. No. 3,446,032 discloses a liquid-liquid heat exchanger comprising an outer casing and an inner, thermally-conductive casing, each having an inlet and an outlet for fluid. The inner casing may be fluted in the direction of fluid flow to increase the heat transfer surface and to assist in maintaining turbulent flow of refrigerant. A helical coil may be provided on the inner casing. A helically spiraled strip member may be provided within the inner casing.

Hess U.S. Pat. No. 3,851,494 discloses that excessive warming of the compressor input by the heat exchanger that supercools the condenser output may be prevented by a bypass switched in and out by a thermostatic control at the output of the compressor to prevent the final compression temperature from rising to damage lubricating materials and flexible hose materials. A branching valve or a second expansion valve may be used according to whether the bypass is just around the heat exchanger or around both the heat exchanger and the evaporator.

Johnston U.S. Pat. No. 3,952,533 discloses an energy saving refrigeration system with two-phase, liquid-gas mixtures of refrigerant inlet flow having an expansion valve and a pressure regulator upstream therefrom adjusted to maintain a fixed discharge pressure to the expansion valve and having its discharge pressure set sufficiently above the evaporator boiling pressure and sufficiently below the minimum inlet pressure to the pressure regulator.

Wright U.S. Pat. No. 4,359,879 discloses a refrigeration system for cooling and drying hot, moist, compressed air.The liquid refrigerant from the condenser is sub-cooled to eliminate all flash gas and render the entire evaporator effective for refrigeration purposes. The heat exchangers for the evaporator and for sub-cooling the liquid refrigerant comprise a one-piece finned copper inner cylinder with the routed fin enclosed inside an annular copper shell in which a 0.020-inch clearance exists between the annular copper shell and the fins to allow passage of a stream of air which causes the laminar flow around the routed fin construction to be agitated by eddy diffusion. The use of the novel heat exchanger in the refrigeration system along with the step of sub-cooling the liquid refrigerant is reported to produce a substantial gain in refrigeration without an increased requirement for either power or energy.

Nunn et al U.S. Pat. No. 4,577,468 discloses the use of a sub-cooler for liquid refrigerant flowing from the condenser comprising a heat exchanger having an inner and an outer tube. The hot liquid refrigerant flows through the outer tube and a small amount of liquid refrigerant is evaporated in the inner tube to cool the liquid refrigerant.

SUMMARY OF THE INVENTION

It is one object of this invention to provide a new and improved refrigeration system having greatly improved efficiency of operation.

Another object of the invention is to provide a refrigeration system with substantially increased refrigeration effect without an increase in the power or energy requirement.

Another object of the invention is to provide a refrigeration system in which the hot gas refrigerant from the compressor is pre-cooled before entering the condenser.

Still another object of the invention is to provide a refrigeration system with a pre-cooler which utilizes the heat of vaporization of a portion of the liquid refrigerant to cool the hot gas refrigerant entering the condenser.

Still another object of the invention is to provide refrigeration system having a pre-cooler heat exchanger with multiple passages in heat exchange relation connected so that a small part of the liquid refrigerant flowing from the condenser is expanded and vaporized into one passage to cool the hot gas refrigerant which is flowing through the other passage into the condenser.

Yet another object of the invention is to provide refrigeration system having a pre-cooler heat exchanger with multiple passages in heat exchange relation connected so that a small part of the liquid refrigerant is expanded and vaporized into one passage to cool the hot gas refrigerant which is flowing through the other passage into the condenser, the vaporized refrigerant being connected to join the vaporized refrigerant flowing from the evaporator to the compressor.

Still another object of the invention is to provide a refrigeration system with a first pre-cooler utilizing the heat of vaporization of a portion of the liquid refrigerant to cool the hot gas refrigerant entering the condenser and a second pre-cooler utilizing the heat of vaporization of a portion of the liquid refrigerant to cool the liquid refrigerant flowing from the condenser to the evaporator or to a receiver.

Another object of the invention is to provide refrigeration system having a pre-cooler heat exchanger with multiple passages in heat exchange relation connected so that a small part of the liquid refrigerant is expanded and vaporized into one passage to cool the hot gas refrigerant which is flowing through the other passage into the condenser, and in which the refrigerant used in cooling the hot gas is also connected through a cooling tube in the receiver to further cool the liquid therein.

Another object of the invention is to provide refrigeration system having a pre-cooler heat exchanger with multiple passages in heat exchange relation connected so that a small part of the liquid refrigerant is expanded and vaporized into one passage to cool the hot gas refrigerant which is flowing through the other passage, and in which the refrigerant used in cooling the liquid is also connected through a cooling tube in the receiver to further cool the liquid therein, the vaporized refrigerant being connected to join the vaporized refrigerant flowing from the evaporator back to the compressor.

Another object of the invention is to provide refrigeration system having a first pre-cooler heat exchanger with multiple passages in heat exchange relation connected so that a small part of the liquid refrigerant is expanded and vaporized into one passage to cool the hot gas refrigerant which is flowing through the other passage, and a second pre-cooler heat exchanger with multiple passages in heat exchange relation connected so that a small part of the liquid refrigerant is expanded and vaporized into one passage to cool the liquid refrigerant which is flowing through the other passage into a receiver and then into the evaporator, and in which the refrigerant used in cooling the hot gas and the hot liquid is also connected through a cooling tube in the receiver to further cool the liquid therein, the vaporized refrigerant being connected to join the vaporized refrigerant flowing from the evaporator back to the compressor.

Other objects of the invention will become apparent from the specification and claims as hereinafter related.

The above stated objects and other objects of the invention are accomplished by sub-cooling or pre-cooling the hot gas refrigerant before entering the condenser and optionally pre-cooling liquid refrigerant prior to expansion in the evaporator. The sub-cooling of the hot gas refrigerant entering the condenser and the hot liquid refrigerant aids in maintaining the refrigerant liquid throughout the evaporator, thus rendering the entire evaporator effective for refrigeration. The system includes a pre-cooler heat exchanger which has an outer passage through which the hot gas refrigerant flows and an inner passage, in heat exchange relation therewith, which is connected to receive a small flow of liquid refrigerant bled off from the main stream of the liquid refrigerant entering the evaporator. This heat exchanger is located between the compressor and the condenser. The system optionally includes a second pre-cooler heat exchanger which has an outer passage through which the hot liquid refrigerant flows from the condenser and an inner passage, in heat exchange relation therewith, which is connected to receive a small flow of liquid refrigerant bled off from the main stream of the liquid refrigerant entering the evaporator. This heat exchanger is located between the condenser and the receiver or between the condenser and the evaporator in systems not having a receiver. The flow of the vaporized refrigerant used for cooling in the heat exchanger may flow through a cooling tube in the receiver and is connected to the return flow of vaporized refrigerant flowing from the evaporator to the compressor.

DESCRIPTION OF THE PREFERRED EMBODIMENTS

Figure 1:
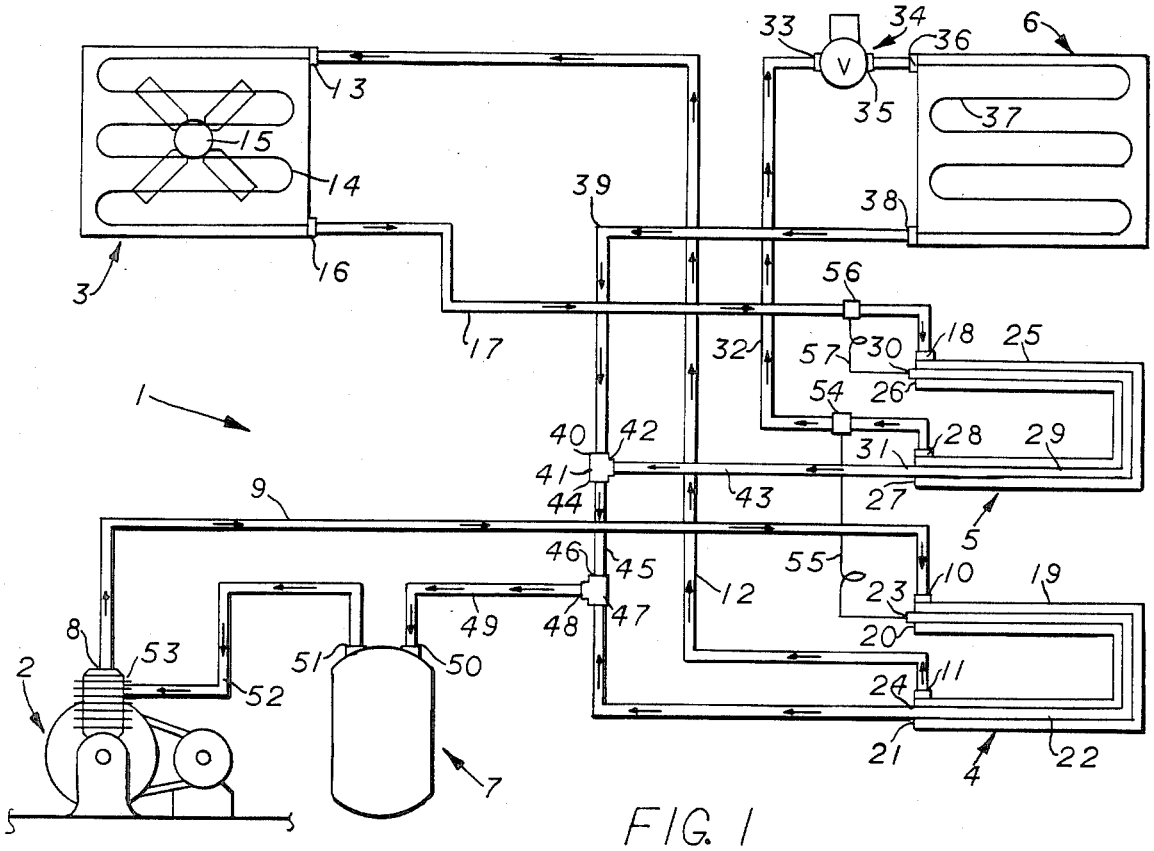
FIG. 1 is a schematic view of one preferred embodiment of this invention comprising an improved refrigeration system having separate pre-cooler heat exchangers connected to sub-cool the hot gas refrigerant flowing from the compressor to the condenser and the liquid refrigerant flowing from the condenser to the evaporator by expansion of a portion of the refrigerant in parallel with the evaporator.

First Embodiment—Refrigeration System Without Receiving and Having Hot Gas and Hot Liquid Refrigerant Pre-Coolers Referring to the drawings by numerals of reference, and more particularly to FIG. 1, there is shown a refrigeration system 1 which may be used for commercial or industrial refrigeration or may provide the cooling for an air conditioning system. Refrigeration system 1 comprises compressor 2, condenser 3, hot gas pre-cooler heat exchanger 4, hot liquid pre-cooler heat exchanger 5, evaporator 6, and suction line accumulator 7.

The refrigeration system is connected with various components arranged in series, with various control elements being in place as indicated below. The outlet 8 from compressor 2 is connected to tubing 9 which leads to the inlet 10 of hot gas pre-cooler 4. The outlet of pre-cooler 4 is connected by tubing 12 to the inlet 13 of heat exchange tubing 14 in condenser 3. Condenser 3 also has a fan 15 to circulate air past the heat exchange tubing 14 for removal of heat therefrom. The outlet 16 from heat exchange tubing 14 is connected by tubing 17 to the inlet 18 of the hot liquid pre-cooler or heat exchanger 5 for subcooling liquid refrigerant prior to its entering the evaporator 6.

Heat exchanger 4 is a direct-expansion refrigerant heat exchanger specially designed to pre-cool the hot gas refrigerant flowing from compressor 2 to condenser 3. Heat exchanger 4 comprises an outer shell or tubing 19 with closed ends 20 and 21 and an inlet 10 at one end and outlet 11 at the other end. An inner shell or tubing 22 extends through the end closures 20 and 21, through the entire length of the outer shell 19, and has an inlet opening 23 at one end and outlet opening 24 at the other end. This heat exchanger can be shaped in a variety of ways, such as being coiled, squared, etc. One form of the heat exchanger which has been tested had a $1\frac{1}{8}$ in. copper tubing as the outer shell with a $\frac{3}{4}$ in. copper tubing forming the inner shell.

Heat exchanger 5 is a direct-expansion refrigerant heat exchanger specially designed to pre-cool the hot liquid refrigerant flowing from condenser 3 to evaporator 6. Heat exchanger 5 comprises an outer shell or tubing 25 with closed ends 26 and 27 and an inlet 18 at one end and outlet 28 at the other end. An inner shell or tubing 29 extends through the end closures 26 and 27, through the entire length of the outer shell 25, and has an inlet opening 30 at one end and outlet opening 31 at the other end. This heat exchanger can be shaped in a variety of ways, such as being coiled, squared, etc. One form of the heat exchanger which has been tested had a $1\frac{1}{8}$ in. copper tubing as the outer shell with a $\frac{3}{4}$ in. copper tubing forming the inner shell.

Outlet 28 from outer shell 25 is connected to tubing 32 leading to the inlet side 33 of refrigeration expansion valve 34. The outlet side 35 of expansion valve 34 is connected to the inlet end 36 of the heat exchange coil or evaporator coil 37 of the evaporator 6. Evaporator coil 37 provides the cooling for a commercial or industrial size refrigeration unit or for cooling air in an air conditioning system. The outlet 38 of evaporator coil 37 is connected to tubing 39 which extends to one inlet 40 of a tee fitting 41. Another inlet 42 of tee fitting 41 is connected to tubing 43 leading from the outlet 31 of the inner shell 29 of liquid heat exchanger or pre-cooler 5. The outlet 44 from tee fitting 41 is connected by tubing to the inlet 46 of a tee fitting 47 having an outlet 49 connected by tubing 49 to the inlet 50 of suction line accumulator 7. The outlet 51 from suction line accumulator 7 is connected by tubing 52 to the inlet 53 at the suction side of compressor 2.

The tubing 9 from the outlet 8 of compressor 2 is connected to the inlet 10 to the outer shell 19 of the hot gas heat exchanger 4. A fitting 54 in tubing line 32 includes an expansion device for bleeding off a small amount of the liquid refrigerant and allowing it to expand and evaporate at a selected and controlled rate. The expansion device as shown is a simple capillary tube 55 of the type used in small capacity refrigeration systems. Of course, the conventional refrigeration expansion valve could be used in this location if desired, particularly in higher capacity systems.

Capillary tube 55 pens into the inlet opening 23 of inner shell 22 and permits a small amount of liquid refrigerant to expand into and evaporate in the inner shell 22 to provide a substantial cooling of the hot gas refrigerant passing through outer shell 19. The expansion of liquid refrigerant and evaporation into inner shell 22 utilizes the latent heat of vaporization of the refrigerant to cool the hot compressed gas from the compressor 2.

The tubing 17 from the outlet 16 of condenser 3 is connected to the inlet 18 to the outer shell 25 of the hot liquid heat exchanger 5. A fitting 56 in tubing line 17 includes an expansion device for bleeding off a small amount of the liquid refrigerant and allowing it to expand and evaporate at a selected and controlled rate. The expansion device as shown is a simple capillary tube 57 of the type used in small capacity refrigeration systems. Of course, the conventional refrigeration expansion valve could be used in this location if desired, particularly in higher capacity systems.

Capillary tube 57 opens into the inlet opening 30 of inner shell 29 and permits a small amount of liquid refrigerant to expand into and evaporate in the inner shell 29 to provide a substantial cooling of the hot liquid refrigerant passing through outer shell 25. The expansion of liquid refrigerant and evaporation into inner shell 29 utilizes the latent heat of vaporization of the refrigerant to cool the hot liquid refrigerant from the condenser 3.

Operation

The condenser 3 performs its normal function of removing the heat picked up in the evaporator 6 which is carried to the compressor 2 in the suction line gas. The compressor 2, in turn, compresses the refrigerant gas which results in a large increase in both pressure and temperature of the gas before it enters the condenser coil 14.

As this high-pressure, high-temperature gas flows through the condenser coil 14, the heat picked up in the evaporator is given off into the air passing over the condenser coils and the refrigerant condenses. Whenever the ambient temperature around the condenser 3 increases, the refrigerant in the condenser has less and less heat removed and the condensed liquid refrigerant leaving the condenser increases substantially in both pressure and temperature. As the temperature of the liquid refrigerant increases, the compressor draws more and more wattage.

The cool suction gas from the evaporator 6 cools the compressor 2 somewhat. However, as the pressure and temperature in the condenser 3 rises with increase in ambient heat, the compressor 2 does not receive enough cooling from the suction gas to offset this rise in ambient temperature, thus causing an increase in wattage consumed. The industry has attempted to correct this by building larger condensing units and also by using liquid line heat exchangers, using suction gas to cool the liquid refrigerant (as described above in the description of the prior art). This has helped but has not solved the problem.

In the embodiment described above, the refrigeration system has been modified by addition of a direct expansion liquid refrigerant heat exchanger, or sub-cooler 5. This device helps to supply cooler liquid refrigerant from the condenser 3 to the metering device or expansion valve 34 at the evaporator 6 and further maintains a cool suction gas to the compressor to facilitate the cooling of the compressor. This greatly reduces the wattage usage of the condenser.

The hot gas refrigerant leaving the compressor 2 passes through the outer shell 19 of heat exchanger 4 which is designed to be of equal overall size as the copper tubing 9 leaving the compressor. This liquid line 9 has a metering device, i.e., capillary 55, tapped into inner shell 22 to provide a predetermined amount of liquid refrigerant to the inner shell for cooling. The expansion of this liquid refrigerant entering the inner shell 22 cools the hot gas refrigerant in the outer shell 19 before entering condenser 3.

The liquid leaving the condenser coil 14 is cooler because of the pre-cooling of the hot gas in the heat exchanger 4 but is still quite hot. The hot liquid from condenser coil 14 passes through the outer shell 25 which is designed to be of equal overall size as the copper tubing 17 leaving the condenser 3. This liquid line 17 has a metering device, i.e., capillary 57, tapped into the inner shell 29 to provide a predetermined amount of liquid refrigerant to the inner shell for cooling.

The expansion of this liquid refrigerant entering the inner shell 29 cools the liquid refrigerant in the outer shell 25 to a temperature of from 40° to 65° depending on the amount of cooling of the liquid refrigerant desired. The cool expanded refrigerant gas leaving the inner shell 22 of the heat exchanger 4 and the cool expanded refrigerant gas leaving the inner shell 29 of the heat exchanger 5 are connected to the suction line 39 from the evaporator. This results in reducing the wattage draw for the condenser.

The cooler liquid refrigerant leaving the outer shell 25 flows to the expansion valve 34 in the evaporator 6 and the expansion of this colder liquid refrigerant in the evaporator tubes results in a colder evaporator, causing a larger temperature spread across the evaporator coils. This increase in the temperature spread across the evaporator coils increases the B.T.U. efficiency of the unit while reducing the wattage consumption.

In this embodiment of the system, a new approach is used to improving the efficiency of refrigeration and air conditioning systems. The principle used as a basic requirement is a sub-cooled refrigerant leaving the condenser which will lower the temperature of the liquid refrigerant entering the expansion valve. As a result, the flash-gas entering the evaporator will be considerably colder, resulting in a much larger temperature spread between the air entering the coil and the temperature of the air leaving the evaporator coil. Tests show a superheat across the coil of 12° with a temperature difference of 21°.

This system utilizes a direct expansion cooling of liquid refrigerant as in applicants' U.S. Pat. No. 2,577,468 and adds to it the direct expansion cooling of the hot gas from the compressor prior to entering the condenser. The addition of the hot gas cooler results in a further increas in efficiency of the system of up to 30%.

The operating principle of this system is to reduce the temperature of the liquid refrigerant being supplied to the evaporator coil. By reducing the temperature of the liquid refrigerant, a much colder evaporator coil is obtained as well as reducing the head pressure on the compressor, all of which results in a lower wattage draw on the unit. The use of the direct expansion heat exchangers or sub-coolers 4 and 5 effectively establishes a second evaporator in parallel with the main evaporator 6 and utilizes the latent heat of vaporization of the liquid to cool the hot refrigerant gas and hot refrigerant liquid. As previously noted, the prior art has tried precooling the liquid refrigerant with the suction line gas but the amount of available cooling is minuscule in comparison with the cooling effected by the direct expansion heat exchangers 4 and 5.

A Second Embodiment—System Having Cooled Receiver

Figure 2:
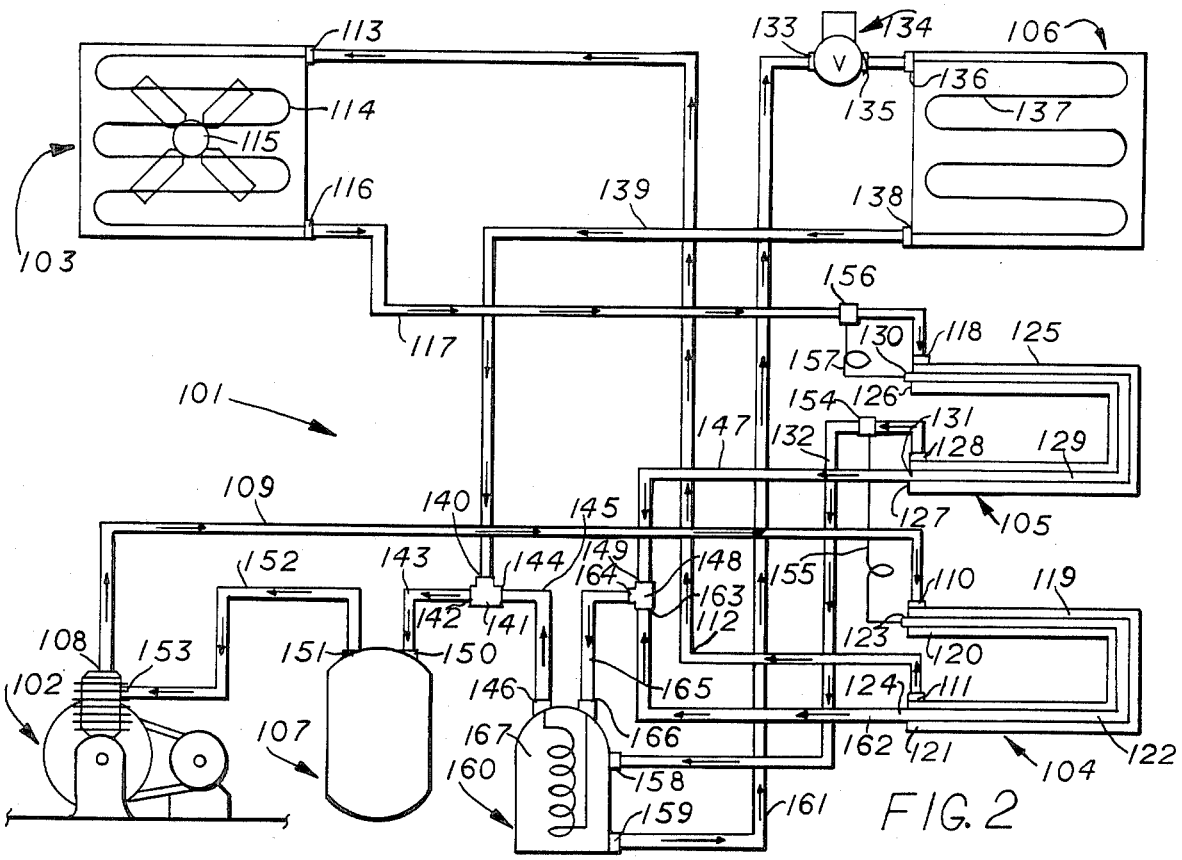
FIG. 2 is a schematic view of another preferred embodiment of this invention comprising an improved refrigeration system having separate pre-cooler heat exchangers connected to sub-cool the hot gas refrigerant flowing from the compressor to the condenser and the liquid refrigerant flowing from the condenser to the evaporator by expansion of a portion of the refrigerant in parallel with the evaporator wherein the refrigerant used in cooling the hot gas and the liquid refrigerant is passed through the receiver to further cool the liquid therein.

In FIG. 2, there is shown another embodiment of the refrigeration system shown in FIG. 1 wherein the system is provided with a receiver for liquid refrigerant and an additional heat exchanger coil for further cooling the liquid refrigerant flowing from the pre-cooler heat exchanger. Components which are the same as in FIG. 1 are given the same reference numerals increased by one hundred.

In FIG. 2, there is shown a refrigeration system 101 comprising compressor 102, condenser 103, liquid refrigerant receiver 160, hot gas pre-cooler heat exchanger 104, hot liquid pre-cooler heat exchanger 105, evaporator 106, and suction line accumulator 107.

The refrigeration system is connected with various components arranged in series, with various control elements being in place as indicated below. The outlet 108 from compressor 102 is connected to tubing 109 which leads to the inlet 110 of hot gas pre-cooler 104. The outlet 111 of precooler 104 is connected by tubing 112 to the inlet 113 of heat exchange tubing 114 in condenser 103. Condenser 103 also has a fan 115 to circulate air past the heat exchange tubing 114 for removal of heat therefrom. The outlet 116 from heat exchange tubing 114 is connected by tubing 117 to the inlet 118 of the hot liquid pre-cooler or heat exchanger 105 for subcooling liquid refrigerant prior to its entering the evaporator 106.

Heat exchanger 104 is a direct-expansion refrigerant heat exchanger specially designed to pre-cool the hot gas refrigerant flowing from compressor 102 to condenser 103. Heat exchanger 104 comprises an outer shell or tubing 119 with closed ends 120 and 121 and an inlet 110 at one end and outlet 111 at the other end. Inner tubing 122 extends through the end closures 120 and 121, through the entire length of the outer shell 119, and has an inlet opening 123 at one end and outlet opening 124 at the other end. This heat exchanger can be shaped in a variety of ways, such as being coiled, squared, etc. One form of the heat exchanger which has been tested has a $1\frac{1}{8}$ in. copper tubing as the outer shell with a $\frac{3}{4}$ in. copper tubing forming the inner shell.

Heat exchanger 105 is a direct-expansion refrigerant heat exchanger specially designed to pre-cool the hot liquid refrigerant flowing from condenser 103 to evaporator 106. Heat exchanger 105 comprises an outer shell or tubing 125 with closed ends 126 and 127 and an inlet 118 at one end and outlet 128 at the other end. An inner shell or tubing 129 extends through the end closures 126 and 127, through the entire length of the outer shell 125, and has an inlet opening 130 at one end and outlet opening 131 at the other end. This heat exchanger can be shaped in a variety of ways, such as being coiled, squared, etc. One form of the heat exchanger which has been tested had a $1\frac{1}{8}$ in. copper tubing as the outer shell with a $\frac{3}{4}$ in. copper tubing forming the inner shell.

Outlet 128 from outer shell 125 is connected by tubing 132 to the inlet 158 to liquid receiver 160. The outlet 159 of receiver 160 is connected by tubing 161 to the inlet side 133 of refrigeration expansion valve 134. The outlet side 135 of expansion valve 134 is connected to the inlet end 136 of the heat exchange coil or evaporator coil 137 of the evaporator 106. Evaporator coil 137 provides the cooling for a commercial or industrial size refrigeration unit or for cooling air in an air conditioning system.

The outlet 138 of evaporator coil 137 is connected to tubing 139 which extends to one inlet 140 of tee fitting 141. The outlet 142 of tee 141 is connected by tubing 143 to the inlet 150 of suction line accumulator 107. Another inlet 144 of tee 141 is connected to tubing 145 leading from heat exchange outlet 146 on receiver 160. The outlet 151 from suction line accumulator 107 is connected by tubing 152 to the inlet 153 at the suction side of compressor 102.

The outlet 131 of the inner shell 129 of liquid heat exchanger or pre-cooler 105 is connected by tubing 147 to one inlet 148 of tee fitting 149. The outlet 124 of tubing 122 in heat exchanger 104 is connected by tubing 162 to another inlet 163 on tee 148. The outlet 164 from tee fitting 148 is connected by tubing 165 to the heat exchange inlet 166 of receiver 160. A heat exchange coil of tubing 167 interconnects inlet 166 and outlet 146 in receiver 160.

The tubing 109 from the outlet 108 of compressor 102 is connected to the inlet 110 to the outer shell 119 of the hot gas heat exchanger 104. A fitting 154 in tubing line 132 includes an expansion device for bleeding off a small amount of the liquid refrigerant and allowing it to expand and evaporate at a selected and controlled rate. The expansion device as shown is a simple capillary tube 155 of the type used in small capacity refrigeration systems. Of course, the conventional refrigeration expansion valve could be used in this location if desired, particularly in higher capacity systems.

Capillary tube 155 opens into the inlet opening 123 of inner shell 122 and permits a small amount of liquid refrigerant to expand into and evaporate in the inner shell 122 to provide a substantial cooling of the hot gas refrigerant passing through outer shell 119. The expansion of liquid refrigerant and evaporation into inner shell 122 utilizes the latent heat of vaporization of the refrigerant to cool the hot compressed gas from the compressor 102.

The tubing 117 from the outlet 116 of condenser 103 is connected to the inlet 118 to the outer shell 125 of the hot liquid heat exchanger 105. A fitting 156 in tubing line 117 includes an expansion device for bleeding off a small amount of the liquid refrigerant and allowing it to expand and evaporate at a selected and controlled rate. The expansion device as shown is a capillary tube 157 of the type used in small capacity refrigeration systems. Of course, the conventional refrigeration expansion valve could be used in this location if desired, particularly in higher capacity systems.

Capillary tube 157 opens into inlet opening 130 of inner shell 129 and permits a small amount of liquid refrigerant to expand into and evaporate in the inner shell 129 to provide a substantial cooling of the hot liquid refrigerant passing through outer shell 125. The expansion of liquid refrigerant and evaporation into inner shell 129 utilizes the latent heat of vaporization of the refrigerant to cool the hot liquid refrigerant from the condenser 103.

Operation of Second Embodiment

The condenser 103 performs its normal function of removing the heat picked up in the evaporator 106 which is carried to the compressor 102 in the suction line gas. The compressor 102, in turn, compresses the refrigerant gas which results in a large increase in both pressure and temperature of the gas before it enters the condenser coil 114.

As this high-pressure, high-temperature gas flows through the condenser coil 114, the heat picked up in the evaporator is given off into the air passing over the condenser coils and the refrigerant condenses. Whenever the ambient temperature around the condenser 103 increases, the refrigerant in the condenser has less and less heat removed and the condensed liquid refrigerant leaving the condenser increases substantially in both pressure and temperature. As the temperature of the liquid refrigerant increases, the compressor draws more and more wattage.

The cool suction gas from evaporator 106 cools the compressor 102 somewhat. However, as the pressure and temperature in condenser 103 rises with increase in ambient heat, the compressor 102 does not receive enough cooling from the suction gas to offset this rise in ambient temperature, thus causing an increase in wattage consumed.

In the embodiment described above, the refrigeration system has been modified by addition of a suction line heat exchanger to further cool the liquid in the receiver 160. The direct expansion heat exchangers 104 and 105 function in the same manner as heat exchangers 4 and 5 in the embodiment shown in FIG. 1.

The liquid leaving the condenser coil 114 is cooler because of the pre-cooling of the hot gas in the heat exchanger 104 but is still quite hot. The hot liquid from condenser coil 114 passes through heat exchanger 104 to cool the liquid refrigerant. The cool expanded refrigerant gas leaving the inner shell 122 of the heat exchanger 104 and the cool expanded refrigerant gas leaving the inner shell 129 of the heat exchanger 105 are connected to the suction line 39 from the evaporator and passed through coil 167 in receiver 160 to further cool the liquid refrigerant.

The cooler liquid refrigerant leaving the receiver 160 flows to the expansion valve 134 in the evaporator 106 and the expansion of this colder liquid refrigerant in the evaporator tubes results in a colder evaporator, causing a larger temperature spread across the evaporator coils. This increase in the temperature spread across the evaporator coils increases the B.T.U. efficiency of the unit while reducing the wattage consumption. The addition of the heat exchanger in the liquid receiver results in a further increase in efficiency of the system.

A Third Embodiment—System Having Hot Gas Cooler

Figure 3:
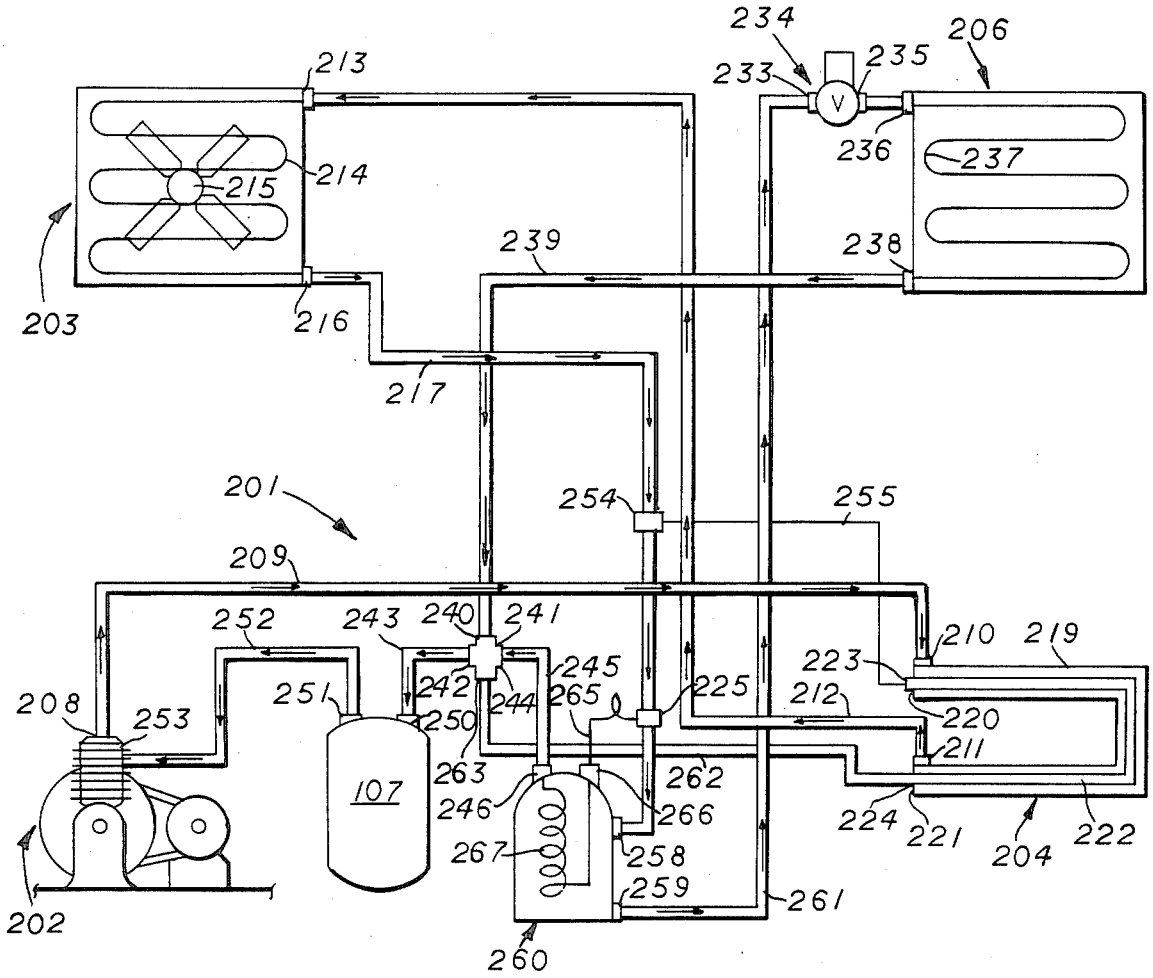
FIG. 3 is a schematic view of still another preferred embodiment of this invention comprising an improved refrigerant system having a pre-cooler heat exchanger connected to sub-cool the hot gas refrigerant flowing from the compressor to the condenser by expansion of a portion of the refrigerant in parallel with the evaporator wherein the refrigerant used in cooling the hot gas refrigerant is passed through the receiver to further cool the liquid therein.

In FIG. 3, there is shown another embodiment of the refrigeration system shown in FIG. 1 wherein the system is provided with a receiver for liquid refrigerant and direct expansion heat exchange coils for cooling the hot gas flowing to the condenser and liquid refrigerant in the receiver. Components which are the same as in FIG. 1 or FIG. 2 are given the same reference numerals in the two hundred series.

In FIG. 3, there is shown a refrigeration system 201 comprising compressor 202, condenser 203, liquid refrigerant receiver 260, hot gas pre-cooler heat exchanger 204, evaporator 206, and suction line accumulator 207.

The refrigeration system is connected with various components arranged in series, with various control elements being in place as indicated below. The outlet 208 from compressor 202 is connected to tubing 209 which leads to the inlet 210 of hot gas pre-cooler 204. The outlet 211 of precooler 204 is connected by tubing 212 to the inlet 213 of heat exchange tubing 214 in condenser 203. Condenser 203 also has a fan 215 to circulate air past the heat exchange tubing 214 for removal of heat therefrom. The outlet 216 from heat exchange tubing 214 is connected by tubing 217 to the inlet 258 of receiver 260.

Heat exchanger 204 is a direct-expansion refrigerant heat exchanger specially designed to pre-cool the hot gas refrigerant flowing from compressor 202 to condenser 203. Heat exchanger 204 comprises an outer shell or tubing 219 with closed ends 220 and 221 and an inlet 210 at one end and outlet 211 at the other end. Inner tubing 222 extends through the end closures 220 and 221, through the entire length of the outer shell 219, and has an inlet opening 223 at one end and outlet opening 224 at the other end. This heat exchanger can be shaped in a variety of ways, such as being coiled, squared, etc. One form of the heat exchanger which has been tested has a $1\frac{1}{8}$ in. copper tubing as the outer shell with a $\frac{3}{4}$ in. copper tubing forming the inner shell.

Outlet 259 from receiver 260 is connected by tubing 261 to the inlet side 233 of refrigeration expansion valve 234. The outlet side 235 of expansion valve 234 is connected to he inlet end 236 of the heat exchange coil or evaporator coil 237 of the evaporator 206. Evaporator coil 237 provides the cooling for a commercial or industrial size refrigeration unit or for cooling air in an air conditioning system.

Outlet 238 of evaporator coil 237 is connected to tubing 239 which extends to one inlet 240 of cross fitting 241. The outlet 242 of cross 241 is connected by tubing 243 to the inlet 250 of suction line accumulator 207. Another inlet 244 of cross 241 is connected to tubing 245 leading from heat exchange outlet 246 on receiver 260. The outlet 251 from suction line accumulator 207 is connected by tubing 252 to the inlet 253 at the suction side of compressor 202.

The outlet 224 of tubing 222 in heat exchanger 204 is connected by tubing 262 to another inlet 263 on cross 241. Tubing 217 has a fitting 225 connected by tubing 265 to the heat exchange inlet 266 of receiver 260. A capillary tube 267 interconnects inlet 266 and outlet 246 in receiver 260 and provides for direct expansion of a small portion of liquid refrigerant to cool further the liquid in receiver 260.

The tubing 209 from the outlet 208 of compressor 202 is connected to the inlet 210 to the outer shell 219 of the hot gas heat exchanger 204. A fitting 254 in tubing 217 includes an expansion device for bleeding off a small amount of the liquid refrigerant and allowing it to expand and evaporate at a selected and controlled rate. The expansion device as shown is a simple capillary tube 255 of the type used in small capacity refrigeration systems. Of course, the conventional refrigeration expansion valve could be used in this location if desired, particularly in higher capacity systems.

Capillary tube 255 opens into the inlet opening 223 of inner shell 22 and permits a small amount of liquid refrigerant to expand into and evaporate in the inner shell 222 to provide a substantial cooling of the hot gas refrigerant passing through outer shell 219. The expansion of liquid refrigerant and evaporation into inner shell 222 utilizes the latent heat of vaporization of the refrigerant to cool the hot compressed gas from the compressor 202.

Operation of Third Embodiment

In this embodiment, the system functions substantially as the system of FIG. 1 but utilizes direct expansion cooling in receiver 260 instead of in a separate heat exchange coil interposed between the condenser and evaporator.

The condenser 203 performs its normal function of removing the heat picked up in the evaporator 206 which is carried to the compressor 202 in the suction line gas. The compressor 202, in turn, compresses the refrigerant gas which results in a large increase in both pressure and temperature of the gas before it enters the condenser coil 214.

As this high-pressure, high-temperature gas flows through the condenser coil 214, the heat picked up in the evaporator is given off into the air passing over the condenser coils and the refrigerant condenses. Whenever the ambient temperature around the condenser 203 increases, the refrigerant in the condenser has less and less heat removed and the condensed liquid refrigerant leaving the condenser increases substantially in both pressure and temperature. As the temperature of the liquid refrigerant increases, the compressor draws more and more wattage.

The cool suction gas from the evaporator 205 cools the compressor 202 somewhat. However, as the pressure and temperature in the condenser 203 rises with increase in ambient heat, the compressor 202 does not receive enough cooling from the suction gas to offset this rise in ambient temperature, thus causing an increase in wattage consumed.

In the embodiment described above, the refrigeration system has been modified by addition of a direct expansion liquid refrigerant heat exchanger, or sub-cooler 267 in the receiver 260. This device helps to supply cooler liquid refrigerant from the receiver 260 to the metering device or expansion valve 234 at the evaporator 206 and further maintains a cool suction gas to the compressor to facilitate the cooling of the compressor. This greatly reduces the wattage usage of the condenser.

The hot gas refrigerant leaving the compressor 202 passes through the outer shell 219 of heat exchanger 204 which is designed to be of equal overall size as the copper tubing 209 leaving the compressor. The liquid line 217 has a metering device, i.e., capillary 255, tapped into inner shell 222 to provide a predetermined amount of liquid refrigerant to the inner shell for cooling. The expansion of this liquid refrigerant entering the inner shell 222 cools the hot gas refrigerant in the outer shell 219 before entering condenser 203.

The liquid leaving the condenser coil 214 is cooler because of the pre-cooling of the hot gas in the heat exchanger 204 but is still quite hot. The hot liquid from condenser coil 214 passes into receiver 260 where it is cooled by the direct expansion coil 267.

The cooler liquid refrigerant leaving receiver 260 flows to the expansion valve 234 in the evaporator 206 and the expansion of this colder liquid refrigerant in the evaporator tubes results in a colder evaporator, causing a larger temperature spread across the evaporator coils. This increase in the temperature spread across the evaporator coils increases the B.T.U. efficiency of the unit while reducing the wattage consumption.

This system utilizes a direct expansion cooling of liquid refrigerant as in FIG. 3 of applicants' U.S. Pat. No. 2,577,568 and adds to it the direct expansion cooling of the hot gas from the compressor prior to entering the condenser. The addition of the hot gas cooler results ina further increase in efficiency of the system of up to 30%.

The operating principle of this system is to reduce the temperature of the liquid refrigerant being supplied to the evaporator coil. By reducing the temperature of the liquid refrigerant, a much colder evaporator coil is obtained as well as reducing the head pressure on the compressor, all of which results in a lower wattage draw on the unit. The use of the direct expansion heat exchangers or sub-coolers 204 and 267 effectively establishes a second evaporator in parallel with the main evaporator 206 and utilizes the latent heat of vaporization of the liquid to cool the hot refrigerant gas and hot refrigerant liquid. As previously noted, the prior art has tried pre-cooling the liquid refrigerant with the suction line gas but the amount of available cooling is minuscule in comparison with the cooling effected by the direct expansion heat exchangers 4 and 5.

While this invention has been described fully and completely with special interest on three preferred embodiments, it should be understood that, within the scope of the appended claims, the invention may be practiced otherwise than as specifically described herein.

We claim:

1. In a method of refrigeration in which a refrigerant gas is compressed, then condensed to a hot liquid refrigerant and finally expanded at a selected rate to evaporate and thereby effect refrigerant cooling, the improvement which comprises cooling the hot gas refrigerant entering the condenser by evaporation of a small portion of said liquid before the expansion and evaporation of the main body of said liquid at said selected rate, said evaporation of said small portion of liquid refrigerant is carried out by passing the same through an inner passage in heat exchange with the hot compressed refrigerant gas in a surrounding outer passage.

2. A method according to claim 1, further including cooling the main body of liquid refrigerant flowing from the condenser by evaporation of a small portion of said liquid before the expansion and evaporation of the main body of said liquid at said selected rate.

said evaporation of said small portion of liquid refrigerant being carried out by passing the same through an inner passage in heat exchange with a main body of liquid in a surrounding outer passage.

3. A method according to claim 2 in which the refrigerant flows from said condenser to a liquid refrigerant receiver, and is vaporized in a heat exchange tube inside said receiver to cool the liquid refrigerant therein.

4. A refrigeration system comprising a compressor, a condenser, and an evaporator connected in series with the outlet of the compressor being connected to the inlet to the condenser to conduct compressed refrigerant gas thereto, the outlet of the condenser connected to the inlet of the evaporator to conduct liquid refrigerant thereto, and the outlet of the evaporator connected to the inlet to the compressor to conduct vaporized refrigerant thereto, further including heat exchange means positioned between the outlet from said compressor and the inlet to said condenser to precool the hot gas refrigerant flowing therebetween by vaporization of part of the liquid refrigerant flowing from said condenser to said evaporator, said heat exchange means comprising a heat exchanger having two flow passages one inside the other, each having an inlet and an outlet, and in heat exchange relation one with the other, the outer one of said heat exchange flow passages being connected between said compressor and said condenser to conduct the hot gas therethrough surrounding said inner flow passage, and the inner one of said heat exchange flow passages being connected to receive a small portion of the liquid refrigerant flowing from said condenser and permit the same to evaporate to cool the hot gas refrigerant flowing through said outer surrounding flow passage.

5. A refrigeration system according to claim 4 further including expansion means connected at the inlet end of said inner heat exchange flow passage to receive liquid refrigerant from said condenser and effect the vaporization thereof into said inner flow passage for cooling said hot gas refrigerant flowing through the outer, surrounding flow passage.

6. A refrigeration system according to claim 4 in which said expansion means comprises a capillary tube.

7. A refrigeration system according to claim 4 in which the outlet end of said outer heat exchange flow passage is connected to the inlet end of said condenser, and the outlet end of said inner heat exchange flow passage is connected to the inlet to said compressor.

8. A refrigeration system according to claim 4 further including expansion means connected at the inlet end of said inner heat exchange flow passage to receive liquid refrigerant from said condenser and effect the vaporization thereof into said inner flow passage for cooling said hot gas refrigerant, and in which the outlet end of said outer heat exchange flow passage is connected to the inlet end of said condenser, and the outlet end of said inner heat exchange flow passage is connected to the inlet to said compressor.

9. A refrigeration system according to claim 4 further including a suction line accumulator connected in series between the outlet end of said evaporator and the inlet side of said compressor.

10. A refrigeration system according to claim 9 in which the outlet end of said outer heat exchange flow passage is connected to the inlet end of said condenser, and the outlet end of said inner heat exchange flow passage is connected to the inlet to said suction line accumulator.

11. A refrigeration system according to claim 4 further including a receiver for liquid refrigerant positioned in series between the outlet from said condenser and the inlet to said evaporator, and a heat exchange tube positioned in said liquid receiver, to be surrounded by liquid refrigerant therein, having an inlet connected to the outlet from said inner flow passage and an outlet connected to the inlet to said compressor.

12. A refrigeration system according to claim 11 further including a suction line accumulator connected in series between the outlet end of said evaporator and the inlet side of said compressor.

13. A refrigeration system according to claim 12 in which the outlet end of said outer heat exchange flow passage is connected to the inlet end of said condenser, and the outlet end of said inner heat exchange flow passage is connected to the inlet to said suction line accumulator.

14. A refrigeration system according to claim 4 further including a second heat exchange means positioned between the outlet from said condenser and the inlet to said evaporator to pre-cool the liquid refrigerant flowing therebetween by vaporization of part of the liquid refrigerant before said refrigerant reaches said evaporator, said second heat exchange means comprising a heat exchanger having two flow passages one inside the other, each having an inlet and an outlet, and in heat exchange relation one with the other, the outer one of said second heat exchange flow passages being connected between said condenser and said evaporator in series therewith to conduct the main body of liquid refrigerant flowing therebetween surrounding said inner flow passage, and the inner one of said second heat exchange flow passages being connected to receive a small portion of said liquid refrigerant and permit the same to evaporate to cool the main body of liquid refrigerant flowing through said outer surrounding flow passage.

15. A refrigeration system according to claim 14 further including expansion means connected at the inlet end of said inner second heat exchange means flow passage to receive liquid refrigerant from said condenser and effect the vaporization thereof into said inner flow passage for cooling said main body of liquid refrigerant flowing through the outer, surrounding flow passage.

16. A refrigeration system according to claim 14 in which said expansion means comprises a capillary tube.

17. A refrigeration system according to claim 14 in which the outlet end of said outer second heat exchange means flow passage is connected to the inlet end of said evaporator, and the outlet end of said inner second heat exchange means flow passage is connected to the inlet to said compressor.

18. A refrigeration system according to claim 14 further including a receiver for liquid refrigerant positioned in series between the outlet from said condenser and the inlet to said evaporator, said second heat exchange means being positioned between the outlet from said condenser and the inlet to said liquid receiver to pre-cool the liquid refrigerant flowing therebetween by vaporization of part of the liquid refrigerant before said refrigerant reaches said evaporator, said second heat exchange means comprising a heat exchanger having two flow passages one inside the other, each having an inlet and an outlet, and in heat exchange relation one with the other, the outer one of side second heat exchange means flow passages being connected between said condenser and said receiver in series therewith to conduct the main body of liquid refrigerant flowing therebetween surrounding said inner flow passage, and the inner one of said second heat exchange means flow passages being connected to receive a small portion of said liquid refrigerant and permit the same to evaporate to cool the main body of liquid refrigerant flowing through said outer surrounding flow passage.

19. A refrigeration system according to claim 18 in which said receiver has an inlet connected to the outlet from said outer second heat exchange means flow passage and an outlet connected to the inlet to said evaporator, a heat exchange tube positioned in said liquid receiver, to be surrounded by liquid refrigerant therin, having an inlet connected to the outlet from said inner second heat exchange means flow passage and an outlet connected to the inlet to said compressor.

20. A refrigeration system according to claim 18 further including expansion means connected at the inlet end of said inner second heat exchange means flow passage to receive liquid refrigerant from said condenser and effect the vaporization thereof into said inner second heat exchange means flow passage for cooling said main body of liquid refrigerant in said surrounding outer flow passage.

21. A refrigeration system according to claim 18 further including a suction line accumulator connected in series between the outlet end of said evaporator and the inlet side of said compressor.

22. A refrigeration system according to claim 21 in which the outlet end of said outer second heat exchange means flow passage is connected to the inlet end of said evaporator, and the outlet end of said inner second heat exchange means flow passage is connected to the inlet to said suction line accumulator.

* * * * *